US011022415B2

(12) United States Patent
Harrington et al.

(10) Patent No.: US 11,022,415 B2
(45) Date of Patent: Jun. 1, 2021

(54) BOOSTERLESS BALLISTIC TRANSFER

(71) Applicant: Halliburton Energy Services, Inc., Houston, TX (US)

(72) Inventors: Nicholas Gerald Harrington, Midloathian, TX (US); Carter James Buono, Arlington, TX (US); Jason P. Metzger, Joshua, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 16/615,383

(22) PCT Filed: Dec. 28, 2018

(86) PCT No.: PCT/US2018/067822
§ 371 (c)(1),
(2) Date: Nov. 20, 2019

(87) PCT Pub. No.: WO2020/139365
PCT Pub. Date: Jul. 2, 2020

(65) Prior Publication Data

US 2021/0055091 A1 Feb. 25, 2021

(51) Int. Cl.
*F42D 1/04* (2006.01)
*F42B 3/02* (2006.01)
(Continued)

(52) U.S. Cl.
CPC ..... *F42D 1/043* (2013.01); *E21B 43/1185* (2013.01); *F42B 3/02* (2013.01); *E21B 43/117* (2013.01)

(58) Field of Classification Search
CPC .... F42D 1/043; E21B 43/1185; E21B 43/117; E21B 43/116; E21B 43/118; E21B 43/119; F42B 3/02
(Continued)

(56) References Cited

U.S. PATENT DOCUMENTS 4,716,832 A * 1/1988 Sumner ..... C06C 7/00 102/275.1
5,033,553 A * 7/1991 Miszewski ..... E21B 23/00 175/4.51
(Continued)

OTHER PUBLICATIONS

ISRWO International Search Report and Written Opinion for PCT/US2018/067822 dated Sep. 26, 2019.

*Primary Examiner* — John Cooper
(74) *Attorney, Agent, or Firm* — John Wustenberg; C. Tumey Law Group PLLC

(57) ABSTRACT

A ballistic transfer system, comprising: a housing, wherein the housing is cylindrical, wherein the housing comprises: a central bore that traverses a length of the housing; a first end; wherein the first end is disposed about a first ballistic apparatus; and a second end, wherein the second end is opposite to the first end, wherein the second end is disposed about a second ballistic apparatus; an alignment insert, wherein the alignment insert is secured into the housing; a first detonation transfer line, wherein a portion of the first detonation transfer line is disposed within the alignment insert; and a second detonation transfer line, wherein a portion of the second detonation transfer line is disposed within the alignment insert.

20 Claims, 5 Drawing Sheets

(51) Int. Cl.
*E21B 43/1185* (2006.01)
*E21B 43/117* (2006.01)

(58) Field of Classification Search
USPC ..... 102/275.7; 89/1.15, 151
See application file for complete search history.

(56) References Cited

U.S. PATENT DOCUMENTS 5,123,356 A * 6/1992 Brooks ..... F42D 1/04
102/275.12
5,780,764 A * 7/1998 Welch ..... C06C 5/06
102/318
5,848,646 A * 12/1998 Huber ..... E21B 17/046
166/297
6,295,912 B1 * 10/2001 Burleson ..... C06C 5/06
102/275.12
2011/0024116 A1 * 2/2011 McCann ..... E21B 43/1185
166/297
2012/0298363 A1 * 11/2012 Sampson ..... E21B 43/1185
166/298
2016/0363428 A1 * 12/2016 Potter ..... F42D 1/043

* cited by examiner

BOOSTERLESS BALLISTIC TRANSFER

BACKGROUND

After drilling various sections of a subterranean wellbore that traverses a formation, a casing string may be positioned and cemented within the wellbore. This casing string may increase the integrity of the wellbore and may provide a path for producing fluids from the producing intervals to the surface. To produce fluids into the casing string, perforations may be made through the casing string, the cement, and a short distance into the formation.

These perforations may be created by detonating a series of shaped charges that may be disposed within the casing string and may be positioned adjacent to the formation. Specifically, one or more perforating guns may be loaded with shaped charges that may be connected with a detonator via a detonation transfer line. The perforating guns may then be attached to a tool string that may be lowered into the cased wellbore. Once the perforating guns are properly positioned in the wellbore such that the shaped charges are adjacent to the formation to be perforated, the shaped charges may be detonated, thereby creating the desired perforations.

When an array of perforating guns is utilized, there is a gap between them that the detonation transfer line runs along. Previous devices and methods may leave the detonation transfer line partially exposed to the wellbore environment. This may lead to disconnection between the devices, misfires, or early detonations. These devices and methods include creating seals using the detonation transfer line itself, which is unreliable as the detonation transfer line may shrink under pressure. Further, boosters may be used at the ends of the detonation transfer line to aid in the transfer of detonation between a pair of perforating guns.

BRIEF DESCRIPTION OF THE DRAWINGS

These drawings illustrate certain aspects of some examples of the present disclosure, and should not be used to limit or define the disclosure.

DETAILED DESCRIPTION

This disclosure may generally relate to subterranean operations. More particularly, systems and methods may be provided for transferring detonation between a pair of ballistic apparatuses. Perforating systems and methods that use a ballistic transfer system may maximize cost savings by eliminating the need for boosters and enhance safety in all aspects of perforating activities by preventing misfires, early detonations, and contamination from the surrounding wellbore environment.

Figure 1:
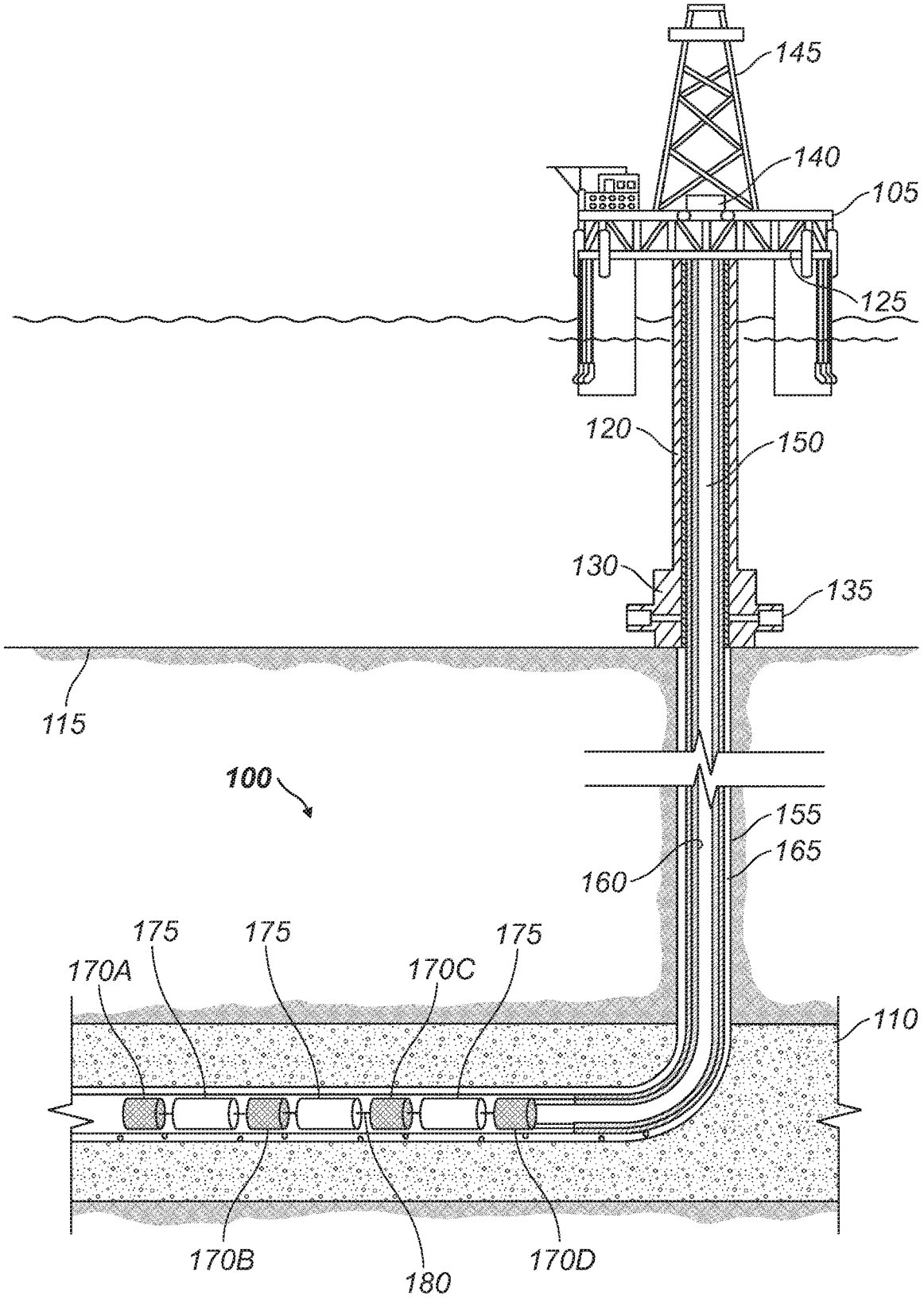
FIG. 1 illustrates an example of a downhole system.

FIG. 1 illustrates an example of a downhole perforating system 100 operating from a platform 105. Platform 105 may be centered over a subterranean formation 110 located below the surface 115. A conduit 120 may extend from deck 125 of platform 105 to wellhead installation 130 including blow-out preventers 135. Platform 105 may have a hoisting apparatus 140 and a derrick 145 for raising and lowering pipe strings, such as, for example, work string 150 which may include the downhole perforating system 100. As illustrated, the downhole perforating system 100 may be disposed on a distal end of work string 150. It should be noted that while FIG. 1 generally depicts a subsea operation, those skilled in the art will readily recognize that the principles described herein are equally applicable to land-based systems, without departing from the scope of the disclosure.

Wellbore 155 may extend through the various earth strata including subterranean formation 110. While downhole perforating system 100 is disposed in a horizontal section of wellbore 155, wellbore 155 may include horizontal, vertical, slanted, curved, and other types of wellbore geometries and orientations in which downhole perforating system 100 may be disposed, as will be appreciated by those of ordinary skill in the art. A casing 160 may be cemented within wellbore 155 by cement 165. When it is desired to perforate subterranean formation 110, the downhole perforating system 100 may be lowered through casing 160 until the downhole perforating system 100 is properly positioned relative to subterranean formation 110. The downhole perforating system 100 may be attached to and lowered via work string 150, which may include a tubing string, wireline, slick line, coil tubing or other conveyance. Upon detonation, components within downhole perforating system 100 may form jets that may create a spaced series of perforations extending outwardly through casing 160, cement 165, and into subterranean formation 110, thereby allowing formation communication between subterranean formation 110 and wellbore 155.

Downhole perforating system 100 may include one or more ballistic apparatuses 170*a*, 170*b*, 170*c*, 170*d*. The ballistic apparatus will be referred to herein collectively as ballistic apparatus 170*a*, 170*b*, 170*c*, 170*d* and individually as first ballistic apparatus 170*a*, second ballistic apparatus 170*b*, third ballistic apparatus 170*c*, and fourth ballistic apparatus 170*d*. Ballistic apparatuses 170*a*, 170*b*, 170*c*, 170*d* may be any device used in a perforating gun for perforating subterranean formation 110, as explained in further detail below. Without limitation, ballistic apparatuses 170*a*, 170*b*, 170*c*, 170*d* may individually be a firing head (e.g., firing head 200 on FIG. 2), a handling subassembly (e.g., handling subassembly 205 on FIG. 2), a gun subassembly (e.g. gun subassembly 210 on FIG. 2) and/or combinations thereof. Additional examples of ballistic apparatuses 170*a*, 170*b*, 170*c*, 170*d* may include, but are not limited to, tubing cutters and setting tools. Downhole perforating system 100 may also include a ballistic transfer system 175, wherein the ballistic transfer system 175 may connect two or more ballistic apparatuses 170*a*, 170*b*, 170*c*, 170*d*. In prior embodiments of downhole perforating system 100, a detonation transfer line 180 (explained in further detail on FIG. 2) would extend between and connect the ballistic apparatuses 170*a*, 170*b*, 170*c*, 170*d* to one another. There may be a need to protect at least a portion of detonation transfer line 180 that is exposed between the ballistic apparatuses 170*a*, 170*b*, 170*c*, 170*d* from the surrounding environment of wellbore 155. Implementation of ballistic transfer system 175 may protect the at least a portion of detonation transfer line 180 from wellbore 155 and may create a pressure and liquid seal between ballistic apparatuses 170*a*, 170*b*, 170*c*, 170*d*. There may be a plurality of ballistic transfer systems 175 disposed between ballistic apparatuses 170*a*, 170*b*, 170*c*, 170*d*. As illustrated, each of the ballistic transfer systems 175 may individually form a sealed connection between first ballistic apparatus 170*a* and second ballistic apparatus 170*b*, between second ballistic apparatus 170*b* and third ballistic apparatus 170*c*, and between third ballistic apparatus 170*c* and fourth ballistic apparatus 170*d*.

Figure 2:
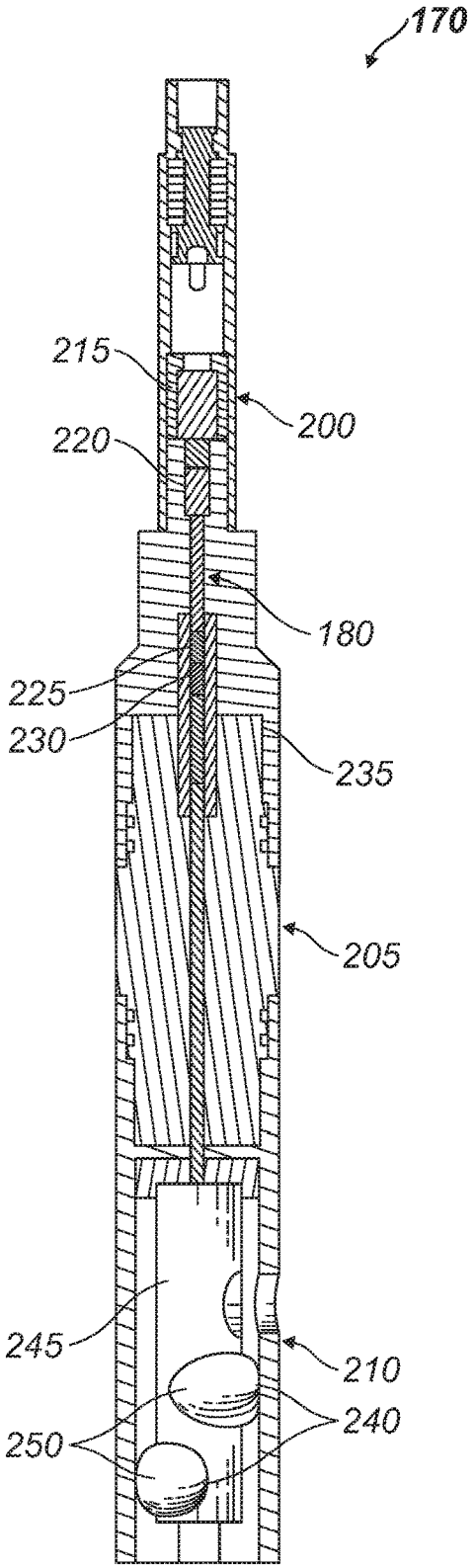
FIG. 2 illustrates an example of a ballistic apparatus.

FIG. 2 illustrates an example of ballistic apparatus 170. As illustrated, firing head 200 may be disposed at an upper end of downhole perforating system 100. Handling subassembly 205 may be disposed between gun subassembly 210 and firing head 200. Handling subassembly 205 may be coupled to firing head 200 and gun subassembly 210 by any suitable means, such as, for example, mechanical fasteners, welds and/or threads. Firing head 200 may include initiation device 215. As illustrated, initiation device 215 may be disposed within at least a portion of firing head 200. Firing head 200 may include detonating cord initiator 220, detonation transfer line 180, and donor booster 225 (bi-directional booster). Detonation transfer line 180 may extend from detonating cord initiator 220 to gun subassembly 210.

Detonation transfer line 180 may be any suitable line for transferring detonation through a plurality of ballistic apparatuses 170. Suitable detonation transfer lines may include, but are not limited to, detonation cords, shock tubes, and detonating fuses among others. Detonation transfer line 180 may include compressed particles of an explosive component. Without limitation, the explosive component in detonation transfer line 180 may include any suitable explosive material (i.e., nitramide) such as, octogen (HMX), hexanitrostilbene (HNS), 2,6-bis(picrylamino)-3,5-dinitropyridine (PYX), 4,10-Dinitro-2,6,8,12-tetraoxa-4,10-diazatetracyclo [5.5.0.05,9.03,11]-dodecane (TEX), triaminotrinitrobenzene or 2,4,6-triamino-1,3,5-trinitrobenzene (TATB), nonanitroterphenyl (NONA), hexogen (RDX), pentaerythritol tetranitrate (PETN), 1,3,5-trinitro-2,4,6-tripicrylbenzene (BRX), 1,3-diamino,2,4,6-trinitrobenzene (DATB), hexanitrobenzene (HNAB), nitrotriazolone (NTO) and/or combinations thereof. Detonation transfer line 180 may comprise an elongated body between two ends. Typically, a first end and/or a second end of detonation transfer line 180 may include any suitable booster, for example, compressed particles of an explosive component.

As illustrated, handling subassembly 205 may include an acceptor booster 230 (bi-directional booster) coupled to detonation transfer line 180. Detonation transfer line 180 may be discontinuous between donor booster 225 and acceptor booster 230. There may be air gap 235 between donor booster 225 and acceptor booster 230. Donor booster 225 and acceptor booster 230 may include compressed particles of an explosive component. Without limitation, the explosive component may include any suitable explosive material. The donor booster 225 may be capable of transmitting a detonation across a discontinuity such as an air gap 235. It does so by its own detonation, in response to a detonation of an adjacent secondary high explosive mass (e.g., detonation transfer line 180), the donor booster 225 detonation yielding a sufficiently high output to enable transmission across the air gap 235 or the like. Because of the output requirements, a donor booster 225 may include a secondary high explosive; such secondary boosters may not continue/allow a detonation over any discontinuity, for example, an air gap 235. This may provide that donor booster 225 and detonation transfer line 180, to which it is coupled, may be in direct physical contact.

An acceptor booster 230, on the other hand, may be one which may detonates in response to another detonation, i.e., in response to the detonation of a donor booster 225 which may be spaced from the acceptor booster 230 by a discontinuity such as an air gap 235. The acceptor booster 230 may further be capable of detonating another secondary high explosive mass (e.g., detonation transfer line 180) in operative association with it by means of the acceptor booster's 230 own detonation. Thus, an acceptor booster 230 may continue/allow a detonation from a donor booster 225, even across a discontinuity, and may transmit the detonation to another secondary high explosive mass so as to continue/allow the detonation. Therefore, to continue/allow the detonation, an acceptor booster 230 may detonate, and not deflagrate.

Initiation device 215 may be coupled to detonating cord initiator 220 and may provide a substantial amount of the energy to initiate detonating cord initiator 220. A signal (e.g., electrical, mechanical, etc.) may be sent form the surface 115 (e.g., shown on FIG. 1) to activate initiation device 215, which may in turn initiate detonating cord initiator 220. Initiation device 215, may include, but is not limited to, a rig environment detonator igniter, industry standard resistor detonators, hotwire igniters, exploding bridgewire igniters, exploding foil initiator igniters, conductive mix igniters, percussion actuated igniters, and a high tension igniting system. Detonating cord initiator 220 may include compressed particles of an explosive component. Without limitation, the explosive component in detonating cord initiator 220 may include any suitable explosive material.

With continued reference to FIG. 2, gun subassembly 210 may be coupled to detonation transfer line 180. Gun subassembly 210 may include shaped charges 240. Initiation of detonation transfer line 180 by initiation device 215 may set off a shock wave that initiates shaped charges 240.

Gun subassembly 210 may further include a charge holder 245. As illustrated, charge holder 245 may be in the form of a cylindrical sleeve. Charge holder 245 may include a plurality of charge holding recesses 250 which hold shaped charges 240. The plurality of shaped charges 240 may be arranged in a spiral pattern such that each of the shaped charges 240 may be disposed on its own level or height and may be individually detonated so that only one shaped charge 240 may be fired at a time. Alternate arrangements of the plurality of shaped charges 240 may be used, including cluster type designs wherein more than one shaped charge 240 may be at a same level and may be detonated at the same time. Upon initiation, shaped charges 240 may generate a jet that may penetrate casing 160, cement 165 and into subterranean formation 110, which are shown on FIG. 1, for example. In order to ensure a successful detonation, ballistic transfer system 175 may be implemented in downhole perforating system 100, as described herein with respect to FIGS. 3-8.

Figure 3:
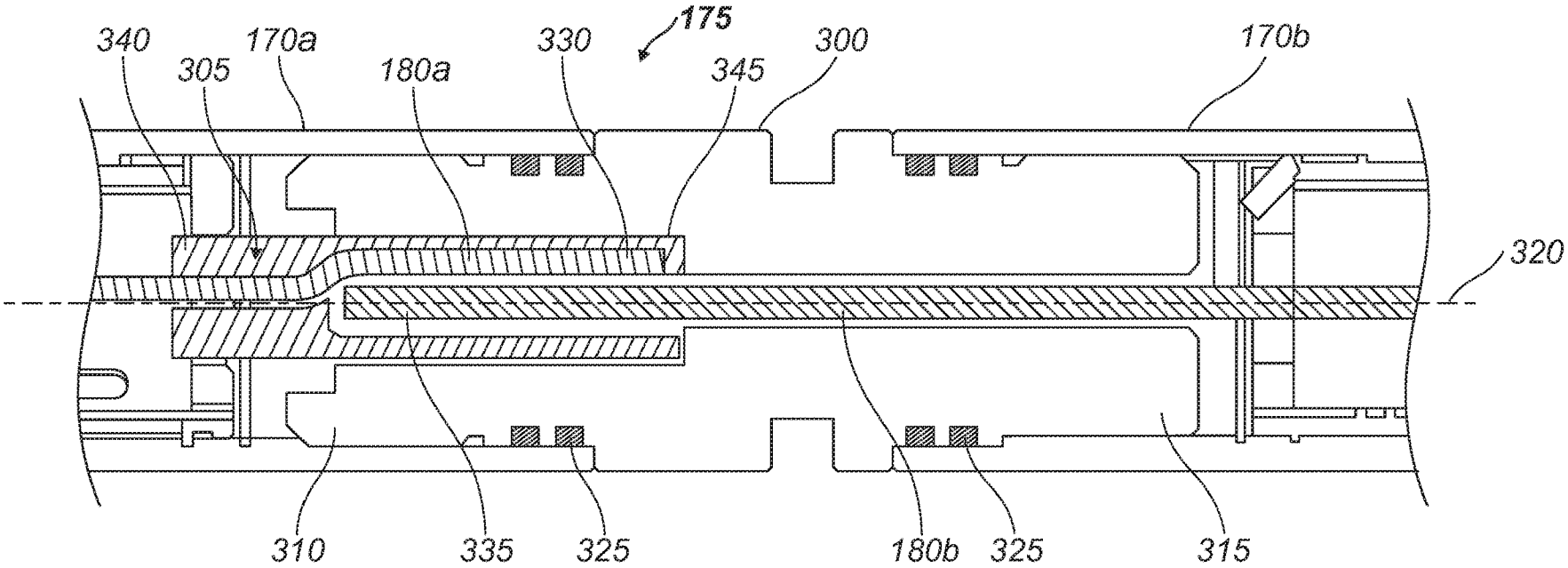
FIG. 3 illustrates an example of a ballistic transfer system.

FIG. 3 illustrates an example of ballistic transfer system 175. Ballistic transfer system 175 may serve to provide a transfer of detonation between a pair of adjacent ballistic apparatuses 170 (i.e., referring to FIG. 1). Ballistic transfer system 175 may comprise a housing 300 and an alignment insert 305. Housing 300 may be any suitable size, height, and/or shape. Without limitation, a suitable shape may include, but is not limited to, cross-sectional shapes that are circular, elliptical, triangular, rectangular, square, hexagonal, and/or combinations thereof. In examples, housing 300 may have a hollow, circular cross-section. Without limitation, housing 300 may comprise any suitable material such as metals, nonmetals, polymers, ceramics, and/or any combination thereof.

As illustrated, housing 300 may be disposed between first ballistic apparatus 170*a* and second ballistic apparatus 170*b*. Housing 300 may comprise a first end 310, a second end 315, and a central axis 320. First end 310 and second end 315 may be used interchangeably. In examples, first end 310 may be secured to first ballistic apparatus 170*a* and second end 315 may be secured to second ballistic apparatus 170*b*, or vice versa. First end 310 and second end 315 may be secured through the use of any suitable mechanisms, including, but not limited to, the use of suitable fasteners, threading, adhesives, welding, and/or combinations thereof. Without limitation, suitable fasteners may include nuts and bolts, washers, screws, pins, sockets, rods and studs, hinges and/or any combination thereof. In examples, O-rings 325 may be used to seal a surface of housing 300 to first ballistic apparatus 170*a* and/or second ballistic apparatus 170*b*. Housing 300 may be partially inserted into first ballistic apparatus 170*a* and/or second ballistic apparatus 170*b*. Alternatively, first ballistic apparatus 170*a* and/or second ballistic apparatus 170*b* may be partially inserted into housing 300. Prior to securing housing 300 between first ballistic apparatus 170*a* and second ballistic apparatus 170*b*, alignment insert 305 may be disposed into housing 300.

Alignment insert 305 may be disposed into housing 300 at first end 310 and/or second end 315. Alignment insert 305 may be secured into housing 300 through the use of any suitable mechanisms, including, but not limited to, the use of suitable fasteners, threading, adhesives, welding, and/or combinations thereof. In alternate examples, alignment insert 305 may be secured about first ballistic apparatus 170*a* and/or second ballistic apparatus 170*b*. Alignment insert 305 may be any suitable size, height, and/or shape. Without limitation, a suitable shape may include, but is not limited to, cross-sectional shapes that are circular, elliptical, triangular, rectangular, square, hexagonal, and/or combinations thereof. In examples, housing 300 may have a hollow, circular cross-section. Without limitation, alignment insert 305 may comprise any suitable material such as metals, nonmetals, polymers, ceramics, and/or any combination thereof. In examples, alignment insert 305 may comprise aluminum, steel, glass-filled Nylon, and/or combinations thereof. Alignment insert 305 may serve to align a first detonation transfer line 180*a* in relation to a second detonation transfer line 180*b*. In examples, an end 330 of first detonation transfer line 180*a* and an end 335 of second detonation transfer line 180*b* may be inserted into alignment insert 305 in any suitable fashion so as to promote detonation transfer between the two. During operations, as first detonation transfer line 180*a* is aligned with second detonation transfer line 180*b*, a transfer of detonation between first ballistic apparatus 170*a* and second ballistic apparatus 170*b* may occur without the use of boosters.

First detonation transfer line 180*a* and second detonation transfer line 180*b* may be used interchangeably. In examples, first detonation transfer line 180*a* may be a donating detonating cord from first ballistic apparatus 170*a*, and second detonation transfer line 180*b* may be an accepting detonating cord from second ballistic apparatus 170*b*. In alternate examples, second detonation transfer line 180*b* may be the donating detonating cord from second ballistic apparatus 170*b*, and first detonation transfer line 180*a* may be an accepting detonating cord from first ballistic apparatus 170*a*. In examples, either first detonation transfer line 180*a* or second detonation transfer line 180*b* may be disposed along central axis 320 of housing 300. As illustrated, second detonation transfer line 180*b* may be disposed along central axis 320, and first detonation transfer line 180*a* may be disposed about second detonation transfer line 180*b* within alignment insert 305. As illustrated in FIG. 3, first detonation transfer line 180*a* may generally be disposed parallel about second detonation transfer line 180*b*. As a portion of both first detonation transfer line 180*a* and second detonation transfer line 180*b* may be disposed through alignment insert 305, there may be a central bore (not illustrated) running the length of alignment insert 305. In some examples, there may be an internal cavity (not illustrated) disposed within first end 310 or second end 315 of housing 300 to accommodate first detonation transfer line 180*a* or second detonation transfer line 180*b*, respectively. In some examples, first detonation transfer line 180*a* may be inserted into alignment insert 305 through a first end 340 of alignment insert, and second detonation transfer line 180*b* may be inserted into alignment insert 305 through a second end 345 of alignment insert 305. In other examples, first detonation transfer line 180*a* may be inserted into alignment insert 305 through second end 345, and second detonation insert 180*b* may be inserted into alignment insert 305 through first end 340.

There may be a designated length of overlap between first detonation transfer line 180*a* and second detonation transfer line 180*b*. Within this length of overlap there may be a maximum cord separation distance between first detonation transfer line 180*a* and second detonation transfer line 180*b*. This measurement may be dependent on explosive loading of first detonation transfer line 180*a* and second detonation transfer line 180*b*. Without limitations, the maximum cord separation distance may be about 0.062 inches (1.6 mm). In examples, the explosive loading of first detonation transfer line 180*a* and/or second detonation transfer line 180*b* may be about 40 gr/ft (8.5 g/m), 80 gr/ft (17 g/m), or 120 gr/ft (25.5 g/m). Typically, boosters may be used to facilitate a transfer of detonation between first ballistic apparatus 170*a* and second ballistic apparatus 170*b*. With regards to the length of overlap and the maximum cord separation distance, transfer of detonation may occur without the use of boosters.

Figure 4:
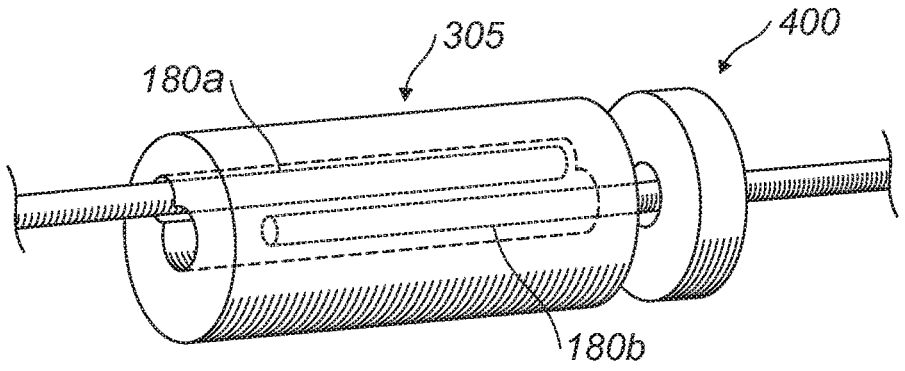
FIG. 4 illustrates an example of an alignment insert.
Figure 5:
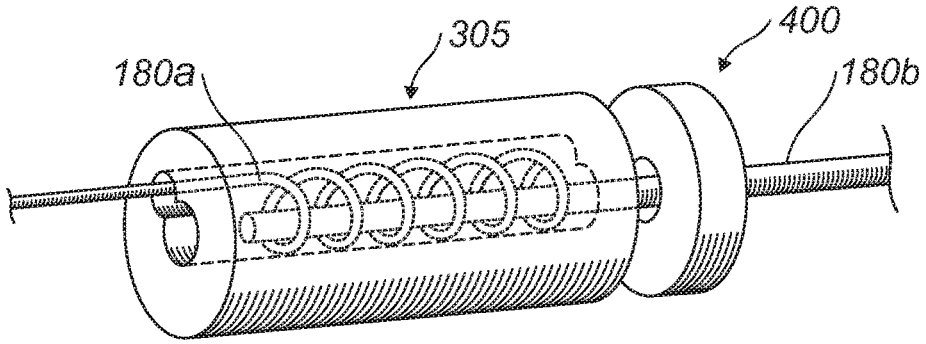
FIG. 5 illustrates an example of an alignment insert.
Figure 6:
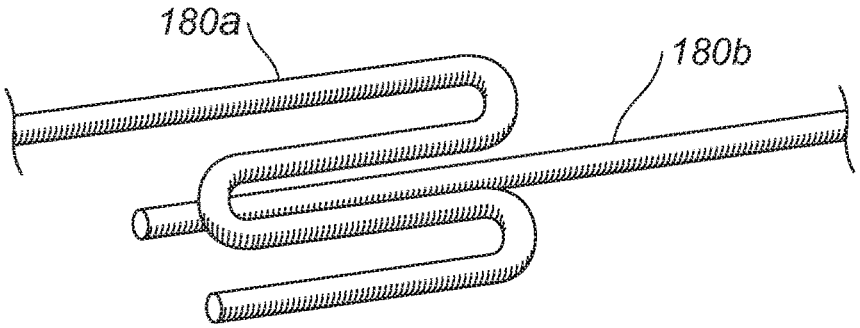
FIG. 6 illustrates an example of a configuration of two detonation transfer lines within an alignment insert.

There may be a multitude of different configurations concerning first detonation transfer line 180*a* and second detonation transfer line 180*b* within alignment insert 305, as illustrated in FIGS. 4-6. These different configurations may vary the shock pressure output of first detonation transfer line 180*a* and/or second detonation transfer line 180*b*. FIG. 4 illustrates an example of alignment insert 305 with a parallel configuration, as used in FIG. 3. FIG. 5 illustrates an example of alignment insert 305 with a spiral configuration. FIG. 6 illustrates an example of a looped configuration for first detonation transfer line 180*a* and second detonation transfer line 180*b*, wherein one of the two is looped back and forth parallel to central axis 320 (i.e., referring to FIG. 3) while the other is disposed in a straight line parallel to central axis 320. As illustrated, a second alignment insert 400 may be used in conjunction with alignment insert 305, as best seen in FIGS. 4-5. Second alignment insert 400 may provide support for one of first detonation transfer line 180*a* or second detonation transfer line 180*b*. Further, second alignment insert 400 may be disposed so as to abut alignment insert 305. In examples, alignment insert 305 may be disposed into housing 300 (e.g., referring to FIG. 3) and second alignment insert 400 may be disposed in gun assembly 210 (e.g., referring to FIG. 2). In alternate examples, alignment insert 305 may be disposed in gun assembly 210 and second alignment insert 400 may be disposed into housing 300.

In examples, the spiral configuration may be used when first detonation transfer line 180*a* and/or second detonation transfer line 180*b* comprise insensitive explosive materials. Without limitations, these insensitive materials may be HNS, TATB, PYX, NONA, TEX, BRX, DATB, HNAB, NTO and/or combinations thereof. Alternatively, this configuration may also be used if either first detonation transfer line 180*a* and/or second detonation transfer line 180*b* comprise a jacket (not illustrated). In those examples, the jacket may retain the explosives during handling and may act as a flyer plate in order to increase the pressure transferred from the donor to the acceptor during detonations transfer. During operations, when an explosive adjacent to a layer of a metallic and/or other solid material detonates (i.e., the jacket), the layer may be accelerated both by the initial detonation shock wave and by the pressure of the detonation gas products. Without limitation, the jacket may comprise any suitable material such as metals, nonmetals, polymers, ceramics, and/or any combination thereof. In examples, the spiral configuration may be used to increase the permissible separation distance between first detonation transfer line 180*a* and second detonation transfer line 180*b* as compared to the parallel configuration (as best seen on FIG. 4).

There may be a plurality of other configurations not presently illustrated. In some examples, the donor shock pressure output may be increased by inserting additional pieces of detonating cord into alignment insert 305 along first detonating transfer line 180*a* and/or second detonation transfer line 180*b*. This may increase the shock pressure input experienced by second detonation transfer line 180*b* and may subsequently increase the likelihood that second detonation transfer line 180*b* initiates. While second detonation transfer line 180*b* may be illustrated as being straight and parallel to central axis 320 (i.e., referring to FIG. 3), in other examples, second detonation transfer line 180*b* may be in a spiral, looped back and forth, and/or combinations thereof. In an alternate example, first ballistic apparatus 170*a* (i.e., referring to FIG. 1) may be coupled directly to second ballistic apparatus 170*b* (i.e., referring to FIG. 1) without the use of housing 300 (i.e., referring to FIG. 3). Without limitations in this example, a pin may be used to couple one end of first ballistic apparatus 170*a* to a box connection on an end of second ballistic apparatus 170*b* by disposing said pin into said box connection.

Figure 7:
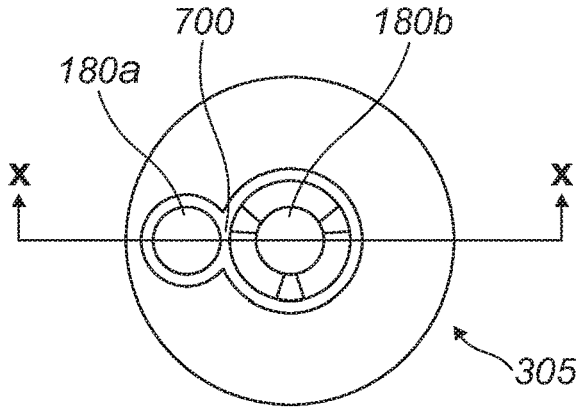
FIG. 7 illustrates a cross-sectional view of an alignment insert.
Figure 8:
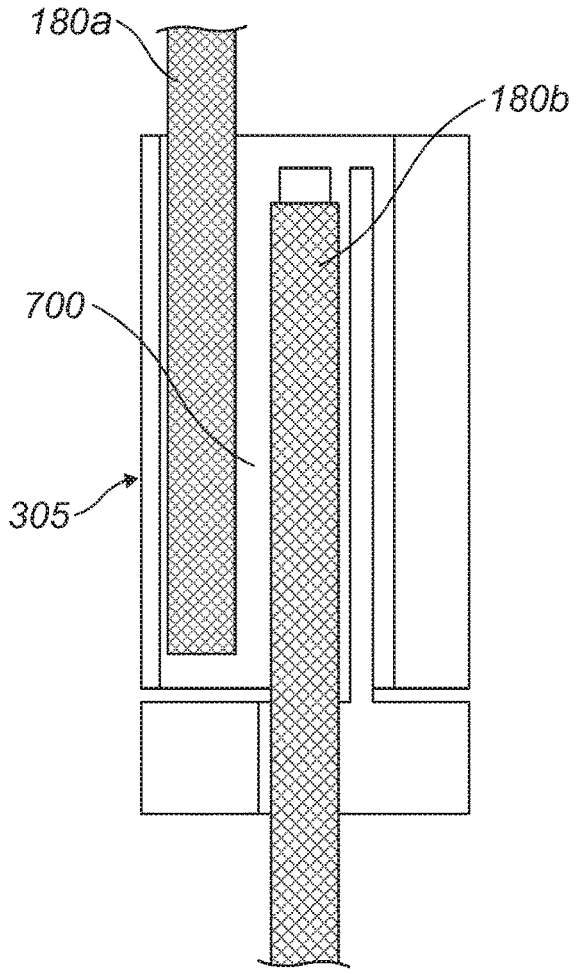
FIG. 8 illustrates a cross-sectional view along section X-X of the alignment insert shown in FIG. 7.

With reference now to FIGS. 7-8, another configuration may be any of the preceding configurations wherein the first detonation transfer line 180*a* and second detonation transfer line 180*b* may be exposed to each other. FIG. 7 illustrates a cross-sectional view of alignment insert 305. FIG. 8 illustrates a cross-sectional view along section X-X of alignment insert 305 as shown in FIG. 7. In regards to FIGS. 7-8, a channel 700 may be cut between first detonation transfer line 180*a* and second detonation transfer line 180*b*. In examples, channel 700 may be any suitable size, height, and/or shape.

The systems and methods may include any of the various features of the systems and methods disclosed herein, including one or more of the following statements.

Statement 1. A ballistic transfer system, comprising: a housing, wherein the housing is cylindrical, wherein the housing comprises: a central bore that traverses a length of the housing; a first end; wherein the first end is disposed about a first ballistic apparatus; and a second end, wherein the second end is opposite to the first end, wherein the second end is disposed about a second ballistic apparatus; an alignment insert, wherein the alignment insert is secured into the housing; a first detonation transfer line, wherein a portion of the first detonation transfer line is disposed within the alignment insert; and a second detonation transfer line, wherein a portion of the second detonation transfer line is disposed within the alignment insert.

Statement 2. The ballistic transfer system of statement 1, wherein the housing further comprises an internal cavity, wherein the alignment insert is disposed into the internal cavity, wherein a central axis of the alignment insert is aligned with the central bore of the housing.

Statement 3. The ballistic transfer system of statement 1 or 2, wherein the alignment insert comprises a material selected from a group consisting of aluminum, steel, glass-filled Nylon, and combinations thereof.

Statement 4. The ballistic transfer system of any one of the preceding statements, wherein the first detonation transfer line comprises a material selected from a group consisting of octogen, hexanitrostilbene, 2,6-bis(picrylamino)-3,5-dinitropyridine, 4,10-Dinitro-2,6,8,12-tetraoxa-4,10-diazatetracyclo[5.5.0.05,9.03,11]-dodecane, triaminotrinitrobenzene or 2,4,6-triamino-1,3,5-trinitrobenzene, nonanitroterphenyl, hexogen, pentaerythritol tetranitrate, 1,3,5-trinitro-2,4,6-tripicrylbenzene, 1,3-diamino,2,4,6-trinitrobenzene, hexanitrobenzene, nitrotriazolone, and combinations thereof.

Statement 5. The ballistic transfer system of any one of the preceding statements, wherein the second detonation transfer line comprises a material selected from a group consisting of octogen, hexanitrostilbene, 2,6-bis(picrylamino)-3,5-dinitropyridine, 4,10-Dinitro-2,6,8,12-tetraoxa-4,10-diazatetracyclo[5.5.0.05,9.03,11]-dodecane, triaminotrinitrobenzene or 2,4,6-triamino-1,3,5-trinitrobenzene, nonanitroterphenyl, hexogen, pentaerythritol tetranitrate, 1,3,5-trinitro-2,4,6-tripicrylbenzene, 1,3-diamino,2,4,6-trinitrobenzene, hexanitrobenzene, nitrotriazolone, and combinations thereof.

Statement 6. The ballistic transfer system of any one of the preceding statements, wherein the portion of the first detonation transfer line is parallel to the portion of the second detonation transfer line within the alignment insert.

Statement 7. The ballistic transfer system of any one of the preceding statements, wherein the portion of the first detonation transfer line is in a spiral around the portion of the second detonation transfer line within the alignment insert.

Statement 8. The ballistic transfer system of any one of the preceding statements, wherein the portion of the first detonation transfer line is looped back and forth parallel to the central bore of the housing within the alignment insert, wherein the portion of the second detonation transfer line is disposed in a straight line parallel to the central bore of the housing within the alignment insert.

Statement 9. The ballistic transfer system of any one of the preceding statements, wherein the alignment insert comprises additional pieces of detonating cord disposed along the portion of the first detonation transfer line or the portion of the second detonation transfer line.

Statement 10. The ballistic transfer system of any one of the preceding statements, further comprising a second alignment insert, wherein the second alignment insert abuts alignment insert.

Statement 11. The ballistic transfer system of any one of the preceding statements, wherein the first detonation transfer line or the second detonation transfer line comprises a jacket, wherein the jacket is configured to act as a flyer plate in order to increase pressure transferred between the first detonation transfer line and the second detonation transfer line during a transfer of detonation.

Statement 12. The ballistic transfer system of any one of the preceding statements, wherein the alignment insert comprises a channel between the portion of the first detonation transfer line and the portion of the second detonation transfer line.

Statement 13. A ballistic transfer system, comprising: a first ballistic apparatus, wherein the first ballistic apparatus comprises a first detonation transfer line; a second ballistic apparatus, wherein the second ballistic apparatus comprises a second detonation transfer line; and an alignment insert, wherein the alignment insert is disposed between the first ballistic apparatus and the second ballistic apparatus, wherein a portion of the first detonation transfer line is disposed within the alignment insert, wherein a portion of the second detonation transfer line is disposed within the alignment insert.

Statement 14. The ballistic transfer system of statement 13, further comprising a housing, wherein the alignment insert is disposed at a first end of the housing, wherein the housing is disposed internally between the first ballistic apparatus and the second ballistic apparatus.

Statement 15. The ballistic transfer system of statement 13 or 14, wherein the portion of the first detonation transfer line is parallel to the portion of the second detonation transfer line within the alignment insert.

Statement 16. The ballistic transfer system of any one of statements 13 to 15, wherein the portion of the first detonation transfer line is in a spiral around the portion of the second detonation transfer line within the alignment insert.

Statement 17. The ballistic transfer system of any one of statements 13 to 16, wherein the portion of the first detonation transfer line is looped back and forth parallel to a central bore of a housing within the alignment insert, wherein the portion of the second detonation transfer line is disposed in a straight line parallel to the central bore of the housing within the alignment insert.

Statement 18. The ballistic transfer system of any one of statements 13 to 17, wherein the alignment insert comprises additional pieces of detonating cord disposed along the portion of the first detonation transfer line or the portion of the second detonation transfer line.

Statement 19. The ballistic transfer system of any one of statements 13 to 18, wherein the first detonation transfer line or the second detonation transfer line comprises a jacket, wherein the jacket is configured to act as a flyer plate in order to increase pressure transferred between the first detonation transfer line and the second detonation transfer line during a transfer of detonation.

Statement 20. The ballistic transfer system of any one of statements 13 to 19, wherein the first ballistic apparatus is coupled to the second ballistic apparatus through a pin and box connection.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A ballistic transfer system, comprising:

a housing, wherein the housing is cylindrical, wherein the housing comprises:

a central bore that traverses a length of the housing;

a first end; wherein the first end is disposed about a first ballistic apparatus; and a second end, wherein the second end is opposite to the first end, wherein the second end is disposed about a second ballistic apparatus;

an alignment insert, wherein the alignment insert is secured into the housing;

a first detonation transfer line, wherein a portion of the first detonation transfer line is disposed within the alignment insert; and a second detonation transfer line, wherein a portion of the second detonation transfer line is disposed within the alignment insert.

2. The ballistic transfer system of claim 1, wherein the housing further comprises an internal cavity, wherein the alignment insert is disposed into the internal cavity, wherein a central axis of the alignment insert is aligned with the central bore of the housing.

3. The ballistic transfer system of claim 1, wherein the alignment insert comprises a material selected from a group consisting of aluminum, steel, glass-filled Nylon, and combinations thereof.

4. The ballistic transfer system of claim 1, wherein the first detonation transfer line comprises a material selected from a group consisting of octogen, hexanitrostilbene, 2,6-bis(picrylamino)-3,5-dinitropyridine, 4,10-Dinitro-2,6,8,12-tetraoxa-4,10-diazatetracyclo [5.5.0.05,9.03,11]-dodecane, triaminotrinitrobenzene or 2,4,6-triamino-1,3,5-trinitrobenzene, nonanitroterphenyl, hexogen, pentaerythritol tetranitrate, 1,3,5-trinitro-2,4,6-tripicrylbenzene, 1,3-diamino,2,4,6-trinitrobenzene, hexanitrobenzene, nitrotriazolone, and combinations thereof.

5. The ballistic transfer system of claim 1, wherein the second detonation transfer line comprises a material selected from a group consisting of octogen, hexanitrostilbene, 2,6-bis(picrylamino)-3,5-dinitropyridine, 4,10-Dinitro-2,6,8,12-tetraoxa-4,10-diazatetracyclo [5.5.0.05,9.03,11]-dodecane, triaminotrinitrobenzene or 2,4,6-triamino-1,3,5-trinitrobenzene, nonanitroterphenyl, hexogen, pentaerythritol tetranitrate, 1,3,5-trinitro-2,4,6-tripicrylbenzene, 1,3-diamino,2,4,6-trinitrobenzene, hexanitrobenzene, nitrotriazolone, and combinations thereof.

6. The ballistic transfer system of claim 1, wherein the portion of the first detonation transfer line is parallel to the portion of the second detonation transfer line within the alignment insert.

7. The ballistic transfer system of claim 1, wherein the portion of the first detonation transfer line is in a spiral around the portion of the second detonation transfer line within the alignment insert.

8. The ballistic transfer system of claim 1, wherein the portion of the first detonation transfer line is looped back and forth parallel to the central bore of the housing within the alignment insert, wherein the portion of the second detonation transfer line is disposed in a straight line parallel to the central bore of the housing within the alignment insert.

9. The ballistic transfer system of claim 1, wherein the alignment insert comprises additional pieces of detonating cord disposed along the portion of the first detonation transfer line or the portion of the second detonation transfer line.

10. The ballistic transfer system of claim 1, further comprising a second alignment insert, wherein the second alignment insert abuts alignment insert.

11. The ballistic transfer system of claim 1, wherein the first detonation transfer line or the second detonation transfer line comprises a jacket, wherein the jacket is configured to act as a flyer plate in order to increase pressure transferred between the first detonation transfer line and the second detonation transfer line during a transfer of detonation.

12. The ballistic transfer system of claim 1, wherein the alignment insert comprises a channel between the portion of the first detonation transfer line and the portion of the second detonation transfer line.

13. A ballistic transfer system, comprising:

a first ballistic apparatus, wherein the first ballistic apparatus comprises a first detonation transfer line;

a second ballistic apparatus, wherein the second ballistic apparatus comprises a second detonation transfer line; and an alignment insert, wherein the alignment insert is disposed between the first ballistic apparatus and the second ballistic apparatus, wherein a portion of the first detonation transfer line is disposed within the alignment insert, wherein a portion of the second detonation transfer line is disposed within the alignment insert.

14. The ballistic transfer system of claim 13, further comprising a housing, wherein the alignment insert is disposed at a first end of the housing, wherein the housing is disposed internally between the first ballistic apparatus and the second ballistic apparatus.

15. The ballistic transfer system of claim 13, wherein the portion of the first detonation transfer line is parallel to the portion of the second detonation transfer line within the alignment insert.

16. The ballistic transfer system of claim 13, wherein the portion of the first detonation transfer line is in a spiral around the portion of the second detonation transfer line within the alignment insert.

17. The ballistic transfer system of claim 13, wherein the portion of the first detonation transfer line is looped back and forth parallel to a central bore of a housing within the alignment insert, wherein the portion of the second detonation transfer line is disposed in a straight line parallel to the central bore of the housing within the alignment insert.

18. The ballistic transfer system of claim 13, wherein the alignment insert comprises additional pieces of detonating cord disposed along the portion of the first detonation transfer line or the portion of the second detonation transfer line.

19. The ballistic transfer system of claim 13, wherein the first detonation transfer line or the second detonation transfer line comprises a jacket, wherein the jacket is configured to act as a flyer plate in order to increase pressure transferred between the first detonation transfer line and the second detonation transfer line during a transfer of detonation.

20. The ballistic transfer system of claim 13, wherein the first ballistic apparatus is coupled to the second ballistic apparatus through a pin and box connection.

* * * * *